US006297941B1

(12) United States Patent
Hoffmann et al.

(10) Patent No.: US 6,297,941 B1
(45) Date of Patent: Oct. 2, 2001

(54) DEVICE FOR CONTROLLING AN ELECTROMECHANICAL ACTUATOR

(75) Inventors: Christian Hoffmann, Regensburg; Richard Wimmer, Parnkofen; Achim Koch, Tegernheim, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/455,606

(22) Filed: Dec. 6, 1999

Related U.S. Application Data

(63) Continuation of application No. PCT/DE98/01318, filed on May 12, 1998.

(30) Foreign Application Priority Data

Jun. 6, 1997 (DE) ..... 197 23 931

(51) Int. Cl.[7] ..... H01H 9/00
(52) U.S. Cl. ..... 361/160; 361/170; 361/187
(58) Field of Search ..... 361/160, 187, 361/170

(56) References Cited

U.S. PATENT DOCUMENTS 5,045,766 * 9/1991 Vermersch ..... 318/293
5,930,103 * 7/1999 Heck ..... 361/187

FOREIGN PATENT DOCUMENTS

| | | | |
|---|---|---|---|
| 3129610A1 | 2/1983 | (DE) | G05F/5/00 |
| 4202805A1 | 8/1993 | (DE) | H01F/7/18 |
| 19518056A1 | 11/1996 | (DE) | H01F/7/16 |
| 19647215A1 | 7/1997 | (DE) | H01F/7/18 |
| 0067936A2 | 12/1982 | (EP) | H03K/17/64 |
| 0309755A1 | 4/1989 | (EP) | F02D/41/40 |
| 0356713A1 | 3/1990 | (EP) | F01L/9/04 |
| 0400389A2 | 12/1990 | (EP) | H01H/47/00 |
| 0669457A1 | 8/1995 | (EP) | F02D/41/40 |
| WO 90/14716 | 11/1990 | (WO) | H03K/17/64 |

* cited by examiner

*Primary Examiner*—Stephen W. Jackson
(74) *Attorney, Agent, or Firm*—Herbert L. Lerner; Laurence A. Greenberg; Werner H. Stemer

(57) ABSTRACT

A device for controlling an electromechanical actuator with an actuating element and an actuating drive. The actuating drive includes an electromagnet which has a core and a coil. The actuating drive, furthermore, has a moveable armature plate. A controller is provided, the control variable of which is the current through the coil and the actuating variable of which is a voltage applied to the coil. A voltage source generates a supply voltage and a pulse width modulator modulates the actuating variable as a function of the supply voltage.

6 Claims, 3 Drawing Sheets

DEVICE FOR CONTROLLING AN ELECTROMECHANICAL ACTUATOR

CROSS-REFERENCE TO RELATED APPLICATION

This is a continuation of copending International Application PCT/DE98/01318, filed May 12, 1998, which designated the United States.

BACKGROUND OF THE INVENTION

FIELD OF THE INVENTION

The invention relates to a device for controlling an electromechanical actuator which has an actuating element and an actuating drive. The actuating drive has a moveable armature plate and an electromagnet with a core and a coil. A controller is provided. The control variable of the controller is the current through the coil and its actuating variable is a voltage which is applied to the coil. The invention relates, in particular, to an actuator for controlling an internal combustion engine.

A prior art actuator of this type with an actuating element and an actuating drive is described, for instance, in U.S. Pat. No. 5,053,911 (European publication EP 0 400 389 A2). There, the actuating drive comprises an electromagnet with a core and with a coil. The electromagnet is disposed in a housing. An armature plate is arranged moveably relative to the first electromagnet and is prestressed into a predetermined position of rest by a spring. In order to bring the armature plate out of its position of rest into bearing contact with the first electromagnet, the coil is energized with a pickup current (attraction current). The pickup current generates an electromagnetic force which pulls the armature plate onto the electromagnet counter to a force generated by the spring. The actuator is assigned a two-state controller with hysteresis, the control variable of which is the current through the coil and the actuating variable of which is a pulse-shaped voltage signal which is applied to the coil.

SUMMARY OF THE INVENTION

It is accordingly an object of the invention to provide a device for controlling an electromechanical actuator, which overcomes the above-mentioned disadvantages of the heretofore-known devices and methods of this general type and which device is simple and ensures accurate, in particular accurately timed, control of the actuator.

With the foregoing and other objects in view there is provided, in accordance with the invention, a device for controlling an electromechanical actuator having an actuating element and an actuating drive with a moveable armature plate and with an electromagnet having a core and a coil. The control device comprises:

- a controller having a current through the coil as a control variable, and having a voltage applied to the coil as an actuating variable;
- a voltage source connected to the controller for generating a supply voltage; and
- the controller having a pulse width modulator adapted to modulate the actuating variable, starting from a jump in a desired value of the controller at least until an actual value of the controller reaches the desired value, in dependence on the supply voltage.

The invention is equally applicable to an actuating element with a second electromagnet that has a further core and a further coil and that is disposed at a predetermined distance from the first electromagnet. In that case there is provided a second controller having the current through the further coil as a control variable and the voltage applied to the further coil as an actuating variable; and a second pulse width modulator modulates the actuating variable of the second controller in dependence on the supply voltage.

In other words, the objects of the invention are satisfied with the pulse width modulator that modulates the actuating variable as a function of the supply voltage. Thus, a constant switching time, irrespective of fluctuations in the supply voltage, is ensured. The switching time is defined as the time required to bring the armature plate from a predetermined position of rest into bearing contact with the electromagnet counter to a spring force generated by the spring. The constant switching time is an important advantage, since, particularly in the case of a motor vehicle, the supply voltage is subject to pronounced fluctuations. Another advantage is that a costly and complicated voltage regulator can be dispensed with, since the current profile in the circuit-closing phase of the regulator, that is to say before the regulating range of the regulator is reached, is, on average over time, always the same, irrespective of the supply voltage, even though only control by the regulator takes place.

In accordance with an advantageous implementation of the invention, the actuating element is a gas exchange valve and the actuator is arranged in an internal combustion engine. Thus, constant switching times of the gas exchange valve, irrespective of the supply voltage, and, consequently, low-consumption and low-emission operation of the internal combustion engine are ensured.

In accordance with a concomitant feature of the invention, the controller is a two-state controller with hysteresis.

Other features which are considered as characteristic for the invention are set forth in the appended claims.

Although the invention is illustrated and described herein as embodied in a device for controlling an electromechanical actuator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Functionally and structurally equivalent elements and components are identified with the same reference symbols throughout the figures.

DESCRIPTION OF THE PREFERRED EMBODIMENTS

Figure 1:
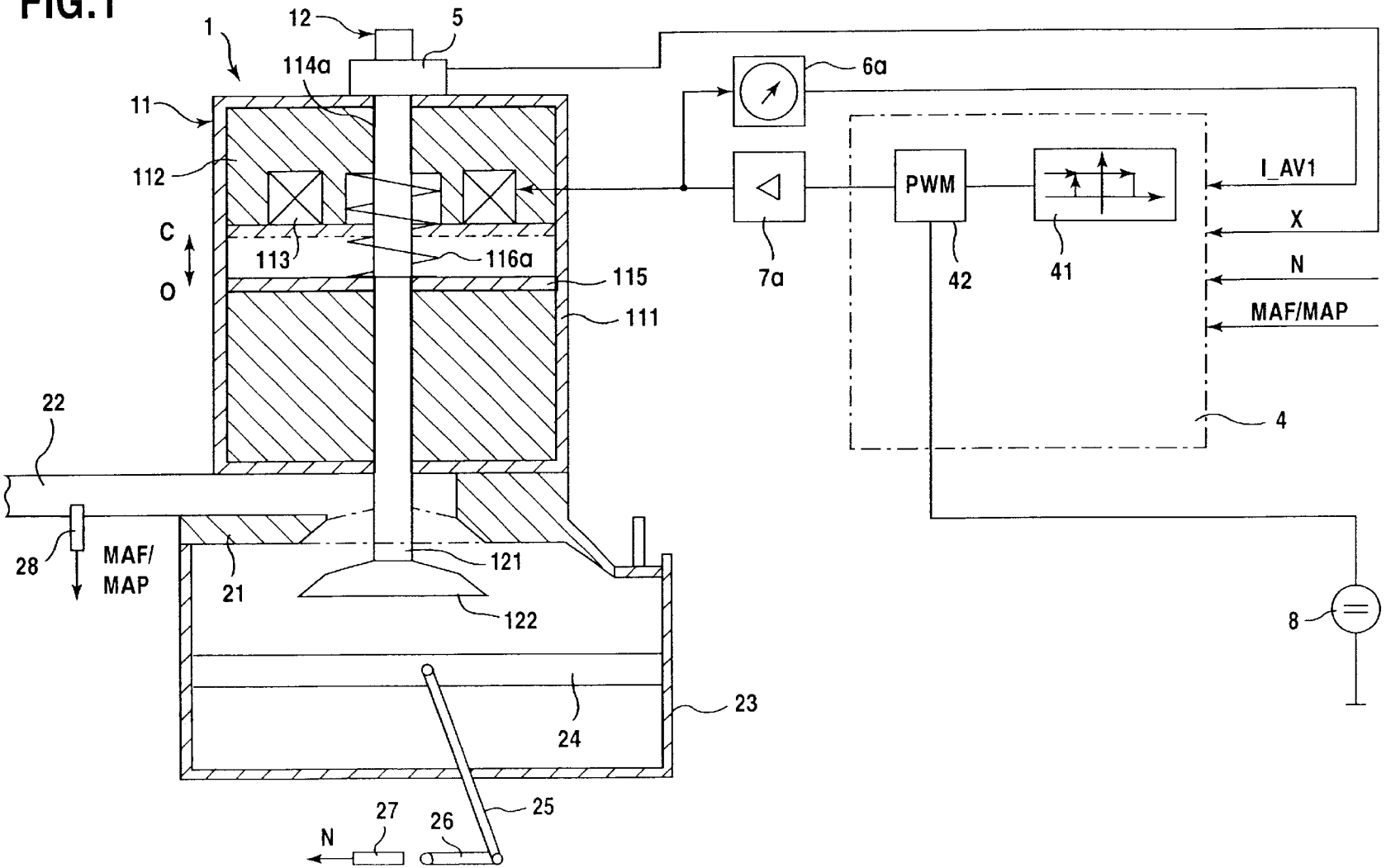
FIG. 1 is a diagrammatic section and schematic view of a configuration of an actuator with a first embodiment of the device according to the invention for controlling the actuator in an internal combustion engine.

Referring now to the figures of the drawing in detail and first, particularly, to FIG. 1 thereof, there is seen an actuator 1 with an actuating drive 11 and an actuating element which is implemented, for example, as a gas exchange valve and which has a stem 121 and a disk 122. The actuating drive 11 has a housing 111, in which a first electromagnet is arranged. The first electromagnet has a first core 112. A first coil 113 is embedded in an annular groove of the first core 112. The first core 112 is formed with a cutout 114*a* which serves for guiding the stem 121. An armature plate 115 is arranged in the housing 111 moveably relative to the first core 112. A first spring 116*a* prestresses the armature plate into a predetermined position of rest R.

The actuator 1 is connected rigidly to a cylinder head 21. The cylinder head 21 is assigned an intake duct 22 and a cylinder 23 with a piston 24. The piston 24 is coupled to a crankshaft 26 via a connecting rod 25.

A control device 4 is provided, which detects signals from sensors and generates actuating signals for the actuating drive 11. The sensors are constructed preferably as a position transmitter 5, which detects a position X of the armature plate 115, as a first ammeter 6*a*, which detects an actual value I_AV1 of the current through the first coil 113, as a rotational speed transmitter 27, which detects the rotational speed N of the crankshaft 26, or as a load detection sensor 28, which is preferably an air mass meter or a pressure sensor. In addition to the sensors mentioned, further sensors may also be present.

A voltage source 8 is provided, which is designed preferably as a generator, as a battery or as a parallel connection of the generator and battery and which generates a supply voltage. The control device 4 comprises a controller which is designed prefer ably as a two-state controller 41 with hysteresis, the control variable of which is the current through the coil 113 and the actuating variable of which is a voltage which is applied to the coil 113. The actuating variable, which, in the time profile, is a voltage signal, is modulated as a function of the supply voltage by a pulse-width modulator 42. The modulated voltage signal is then supplied to a driver 7*a* which amplifies it and supplies it to the first coil 113.

Figure 2:
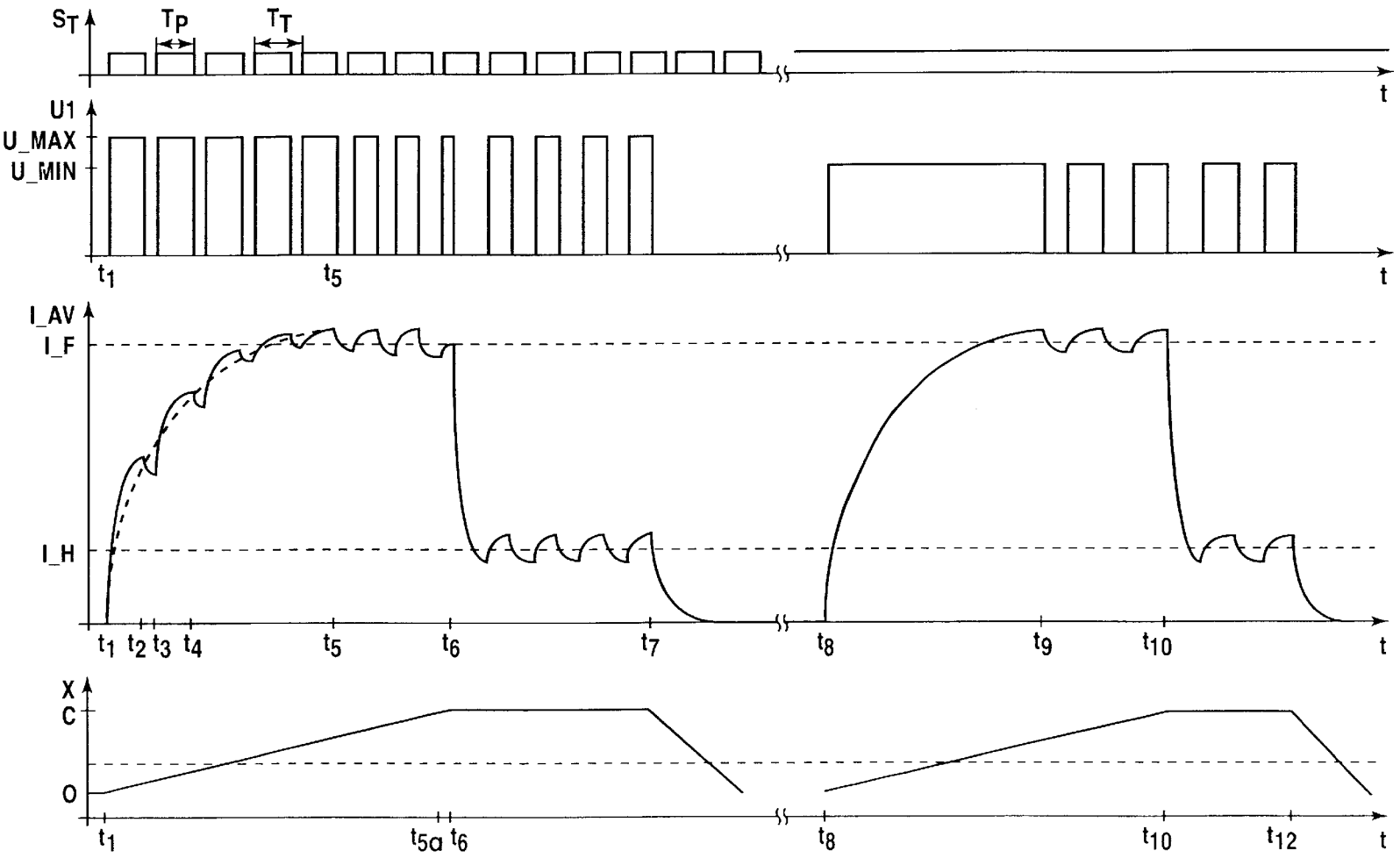
FIG. 2 are four timing diagrams showing various signal profiles plotted over time t.

Reference will now be had to the signal profiles plotted over time t in FIG. 2. The first time line (FIG. 2*a*) shows the time profile of the carrier signal $S_T$ of the pulse width modulator 42. The carrier signal $S_T$ is a pulse train with a period $T_T$ and with a pulse width $T_P$ which is dependent on the supply voltage. If the supply voltage has the maximum value U_MAX, the pulse width $T_P$ has a minimum value (for example, $0.8 \cdot T_T = 80\%$). By contrast, if the supply voltage has the minimum value U_MIN of the supply voltage, the pulse width $T_P$ has a maximum value (for example, $T_P = T_T$) . If the supply voltage has a value between the maximum value U_MAX and the minimum value U_MIN, the value of the pulse with T is between the minimum and the maximum value.

The second time line (FIG. 2*b*) shows the time profile of the modulated and amplified voltage signal U1. The third time line (FIG. 2*c*) shows the associated profile of the actual value I_AV of the current through the first coil 113. The fourth time line (FIG. 2*d*) shows the time profile of the position X of the armature plate 115.

From a time $t_1$ to $t_6$ the desired value of the current through the first coil 113 is a predetermined pickup current I_F. At the time $t_{5a}$, the armature plate 115 comes into bearing contact with the first core 112. From the time $t_6$ to $t_7$, the desired value of the current of the first coil 113 is then a predetermined holding current I_H. The two-state controller 41 with hysteresis accordingly predetermines as a voltage signal, from the time $t_1$, to the time $t_5$, a voltage pulse which is modulated with the carrier signal $S_T$ and is then amplified by the driver 7*a*, so that the profile illustrated on the second time line is obtained from the time $t_1$ to $t_5$. The amplified and modulated voltage signal U1 is applied to the coil 113. The resulting actual value I_AV of the current can be seen clearly on the third time line. From a time $t_1$ to a time $t_5$, the actual value I_AV of the current oscillates about the time profile (dotted curve), such as is obtained when the supply voltage has the minimum value U_MIN.

At the time $t_{5a}$ the armature plate 115 comes into bearing contact with the first core 112. From the time $t_6$ to the time $t_7$, the desired value I_SP1 of the current through the coil is the holding current I_H. The time $t_6$ is preferably selected in such a way as to be as close as possible to the time $t_{5a}$. The impingement of the armature plate 115 is determined preferably by an evaluation of the position X. In a simple embodiment, the time interval between the times $t_1$ and $t_6$ may also be a permanently predetermined value defined experimentally.

At a time $t_8$, the desired value of the current through the first coil 113 changes from zero to the pickup current I_F. From the time $t_8$ to a time $t_{12}$, the supply voltage has the minimum value U_MIN. The pulse width $T_P$ of the carrier signal $S_T$ is therefore equal to the period $T_T$. The carrier signal $S_T$ therefore has a constant value from the time $t_8$ to the time $t_{12}$. From the time $t_8$ to the time $t_{12}$, the time profile of the modulated and amplified voltage signal U1 corresponds, with the exception of the amplitude change brought about by the amplification, to the voltage signal, that is to say to the time profile of the actuating variable of the two-state controller 41. At the time $t_{10}$ the armature plate 115 comes into bearing contact with the first core 112. From the time $t_{10a}$ to the time $t_{12}$, the desired value I_SP1 of the current through the coil 113 is the holding current I_H.

The switching time, which is determined by the time required to bring the armature plate from its open position, which corresponds in this exemplary embodiment to the position of rest R, into its closing position C, that is to say into bearing contact with the first electromagnet, is therefore independent of the value of the supply voltage and is approximately constant. Thus, the time intervals between the times $t_1$ and $t_{5a}$ and between the times $t_8$ and $t_{10}$ are approximately equal. This is an important advantage, since an exact switching time is preconditioned for an accurate control of the filling of the cylinder 23.

Figure 3:
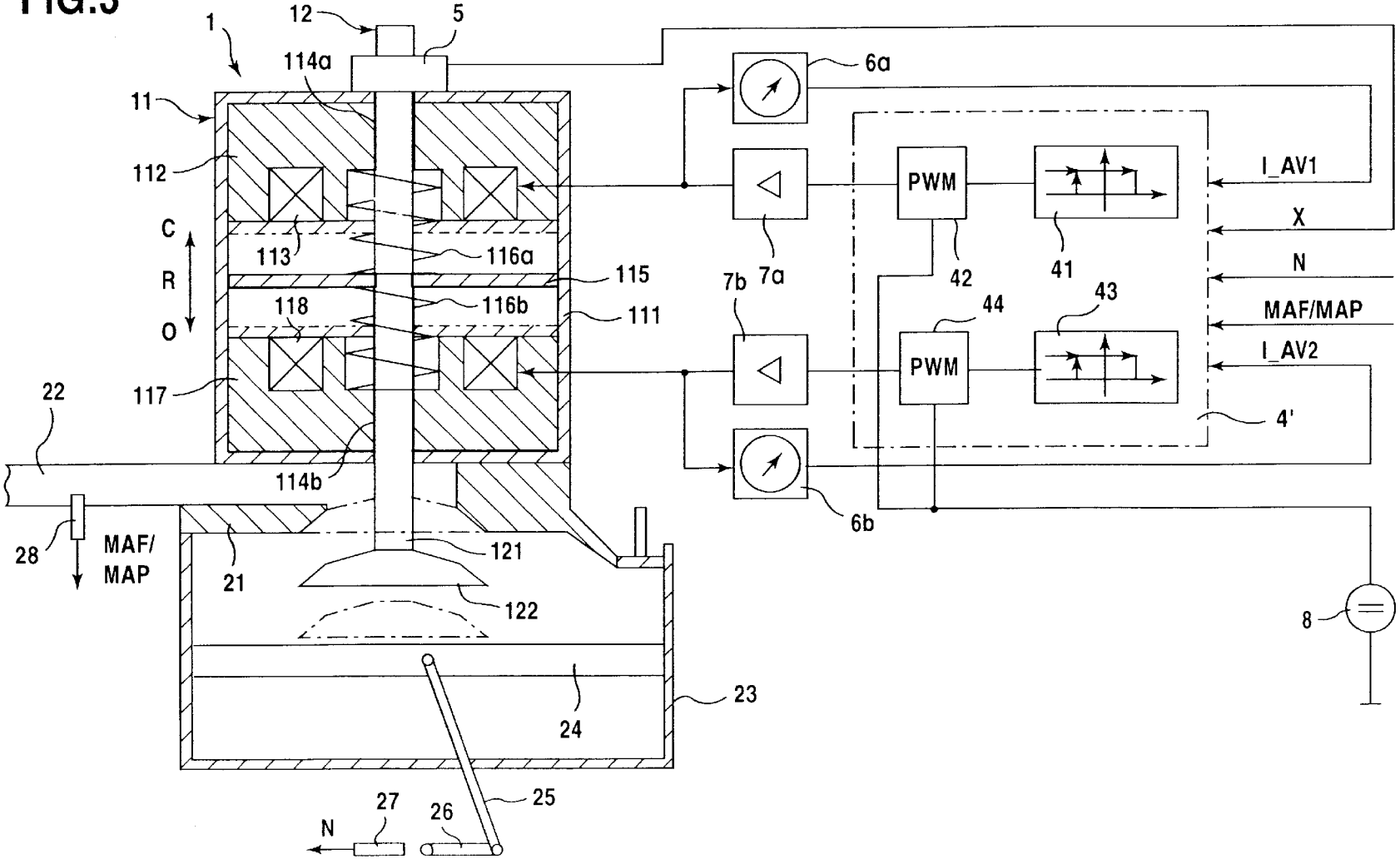
FIG. 3 is a diagrammatic section and schematic view of a further configuration of a preferred embodiment of the actuator with a further embodiment of the device according to the invention for controlling the actuator.

FIG. 3 illustrates a further configuration of the preferred embodiment of the actuator 1 with a further embodiment of the control device 4' according to the invention. The actuating drive 11 differs from that in FIG. 1 in that it has a second electromagnet with a second core 117 and with a second coil 118. The second core 117 has a cutout 114*b* which also serves for guiding the stem 121. The armature plate 115 is arranged in the housing 111 moveably between the first core 112 and the second core 117. The first spring 116*a* and the second spring 116*b* prestress the armature plate into a predetermined position of rest R.

In contrast to the control device 4 according to FIG. 1, the control device 4' additionally has a further two-state controller 43 with hysteresis, the control variable of which is the current for the second coil 118 and the actuating variable of which is a voltage which is applied to the second coil 118. The two-state controller 43 generates a further voltage signal which is supplied as a modulation signal to a further pulse width modulator 44. The further voltage signal is modulated in the further pulse width modulator 44 in exactly the same way as in the pulse width modulator 42 and is then amplified by the driver 7*b*. The further modulated and corrected voltage signal is applied to the second coil 118. The actual current I_AV2 through the second coil 118 is measured by an ammeter 6*b* and a corresponding signal is fed to the control device 4'.

In this exemplary embodiment, the first or second coil must in each case have a substantially lower pickup current I_F applied to it, since the spring/mass system is oscillatable and only the losses due to friction have to be compensated.

It will be understood that the invention is not restricted to the exemplary embodiments. For example, the actuating element may also be implemented as an injection valve. The control device 4, 4' may be designed as a microcontroller, but it may also comprise a logic circuit or an analog circuit configuration. The controller or the further controller may also be designed, for example, as a single-state controller with a timer or as a pulse width modulation controller.

We claim:

1. In combination with an electromechanical actuator having an actuating element and an actuating drive with a moveable armature plate and with an electromagnet having a core and a coil, a device for controlling the electromechanical actuator, comprising:

a controller having a current through the coil as a control variable, and having a voltage applied to the coil as an actuating variable;

a voltage source connected to said controller for generating a supply voltage; and said controller having a pulse width modulator adapted to modulate the actuating variable, starting from a jump in a desired value of the controller at least until an actual value of said controller reaches the desired value, in dependence on the supply voltage.

2. The device according to claim 1, wherein the electromagnet of the actuating element is a first electromagnet and the actuating element has a second electromagnet with a further core and a further coil, the second electromagnet being disposed at a predetermined distance from the first electromagnet, and wherein the device further comprises:

a second controller having a current through the further coil as a control variable and a voltage applied to the further coil as an actuating variable; and a second pulse width modulator adapted to modulate the actuating variable of the second controller, starting from a jump in a desired value of said second controller at least until an actual value of said second controller reaches the desired value, in dependence on the supply voltage.

3. The device according to claim 2, wherein the actuating element is a gas exchange valve.

4. The device according to claim 2, wherein said first and second controllers are each a two-state controller with hysteresis.

5. The device according to claim 1, wherein the actuating element is a gas exchange valve.

6. The device according to claim 1, wherein said controller is a two-state controller with hysteresis.

* * * * *